US010624422B2

(12) United States Patent
Jugeau

(10) Patent No.: US 10,624,422 B2
(45) Date of Patent: Apr. 21, 2020

(54) SILICONE LACE WITH A STRONG VISUAL IDENTITY AND IMPROVED TEAR STRENGTH, AND LACING SYSTEM FORMED BY A PLATE FOR LOCKING THE LACE IN PLACE ON THE SHOE

(71) Applicant: ALPURNA DEVELOPMENT, Saint-Gervais-les-Bains (FR)

(72) Inventor: Laurence Jugeau, Rambouillet (FR)

(73) Assignee: ALPURNA DEVELOPMENT, Saint-Gervais-les-Bains (FR)

( * ) Notice: Subject to any disclaimer, the term of this patent is extended or adjusted under 35 U.S.C. 154(b) by 0 days.

(21) Appl. No.: 15/565,383

(22) PCT Filed: Apr. 11, 2016

(86) PCT No.: PCT/FR2016/050830
§ 371 (c)(1),
(2) Date: Jan. 25, 2018

(87) PCT Pub. No.: WO2016/162651
PCT Pub. Date: Oct. 13, 2016

(65) Prior Publication Data

US 2018/0140051 A1 May 24, 2018

(30) Foreign Application Priority Data

Apr. 9, 2015 (FR) ..... 15 53075
Jul. 3, 2015 (FR) ..... 15 01419

(51) Int. Cl.
*A43C 1/02* (2006.01)
*A43C 7/00* (2006.01)
(Continued)

(52) U.S. Cl.
CPC ..... *A43C 1/02* (2013.01); *A43B 3/0078* (2013.01); *A43C 7/005* (2013.01); *A43C 7/02* (2013.01);
(Continued)

(58) Field of Classification Search
CPC .. A43C 1/02; A43C 7/00; A43C 11/22; A43C 11/24; A43C 11/00; A44C 9/02;
(Continued)

(56) References Cited

U.S. PATENT DOCUMENTS 1,734,736 A * 11/1929 Lotz ..... G09F 7/165 40/615
4,790,048 A * 12/1988 Arnt ..... A43C 7/00 24/712.1
(Continued)

FOREIGN PATENT DOCUMENTS

GB 2142521 1/1985
GB 2411570 9/2005

OTHER PUBLICATIONS

"How to change the SHOEPS Buttons," Youtube video, URL: https://www.youtube.com/watch?v=2jMkEhpobDc (Mar. 29, 2014).
(Continued)

*Primary Examiner* — Jack W Lavinder
(74) *Attorney, Agent, or Firm* — James C. Lydon

(57) ABSTRACT

The invention is intended to provide silicone elastomer laces that are improved in terms of branding and/or ornamentation and/or tear strength and/or additional novel functions other than the mechanical properties and external appearance thereof, as well as a novel lacing solution. For this purpose, the invention relates first to a lace (1) for a shoe (2) equipped with a lace passage (3), the two edges (4, 5) of said passage having through-holes (7). The lace (1) essentially comprises at least one silicone elastomer that is at least partially
(Continued)

cross-linked and includes one or more silicone polymers and fillers and, optionally, at least one of the following compounds: catalyst(s), cross-linking agent(s), pigment(s), parting agent(s), plasticiser(s), adhesion promoter(s). The lace is characterised in that it comprises, in the middle portion thereof, an identification zone (9) which is integral with the lace (1) and which, once the lace (1) has been passed through the through-holes (7, 7*i*) of the shoe (2), is intended to appear on the instep of the shoe (2), between the two lower through-holes (7*i*) located on either side, and at the base of, the lace passage (3) on the shoe (2). The invention also relates to a lace intended to be locked in place on the shoe (2) using a so-called "BlocKnot" plate (30) that is provided with multiple passages (20) for holding the lace (1) in place when the free ends of the strands (81) and (82) of the lace are interlaced through the passages (20) and gripped, preferably by passing the free ends of the strands (81) and (82) through the passages (20) in an alternating manner on the front and rear of the plate (30).

9 Claims, 11 Drawing Sheets

(51) Int. Cl.

| | |
|---|---|
| ***A43C 7/08*** | (2006.01) |
| ***A43C 9/04*** | (2006.01) |
| ***A43C 7/02*** | (2006.01) |
| ***A43B 3/00*** | (2006.01) |
| ***A43C 7/04*** | (2006.01) |
| ***A43C 9/02*** | (2006.01) |
| ***A43C 19/00*** | (2006.01) |

(52) U.S. Cl.
CPC ..... *A43C 7/04* (2013.01); *A43C 9/02* (2013.01); *A43C 9/04* (2013.01); *A43C 19/00* (2013.01)

(58) Field of Classification Search
CPC ... A44C 9/00; Y10T 24/3703; Y10T 24/3724; F16M 13/02
USPC ..... 63/29.1, 30, 40; 40/658, 647, 648, 671, 40/596, 615
See application file for complete search history.

(56) References Cited

U.S. PATENT DOCUMENTS

| | | | | |
|---|---|---|---|---|
| 6,473,944 | B1 * | 11/2002 | Vazin | A43C 1/00 24/129 A |
| 6,477,754 | B1 * | 11/2002 | Alexander | A43B 1/0072 24/712 |
| D594,643 | S | 6/2009 | Moore | |
| D613,938 | S * | 4/2010 | Alexander | D2/976 |
| 2006/0168785 | A1 * | 8/2006 | Kraft | A43C 1/02 24/715.3 |
| 2009/0260267 | A1 | 10/2009 | Evans | |
| 2009/0297793 | A1 | 12/2009 | Yun | |
| 2013/0240703 | A1 * | 9/2013 | Bergmann | F16M 13/02 248/302 |

OTHER PUBLICATIONS

Wikipedia, "Silicone" URL: https://fr.wikipedia.org/w/index.php?title=Silicone&olid=109524414 (Nov. 29, 2011).

* cited by examiner

FIG. 6
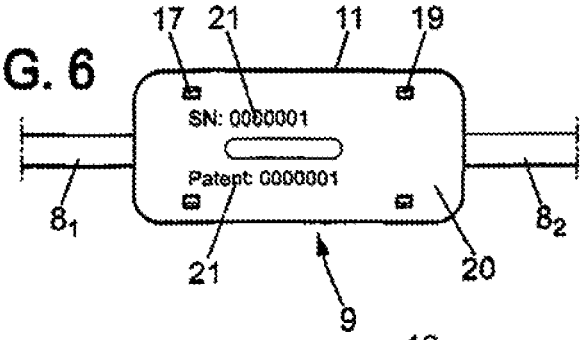
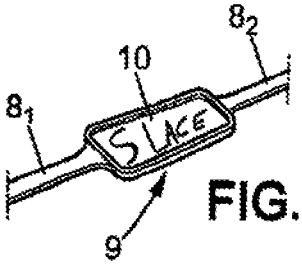
FIG. 7A
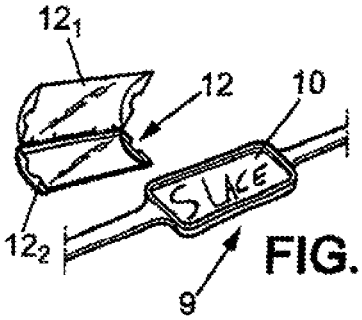
FIG. 7B
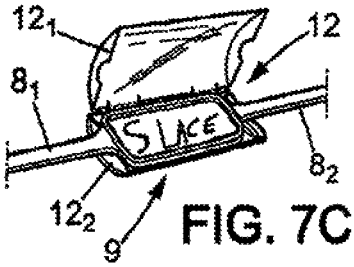
FIG. 7C
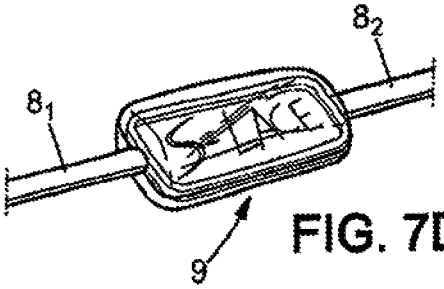
FIG. 7D
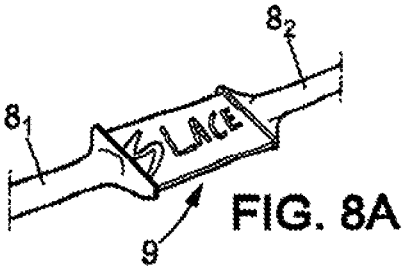
FIG. 8A
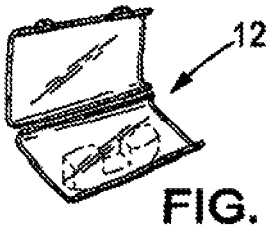
FIG. 8B
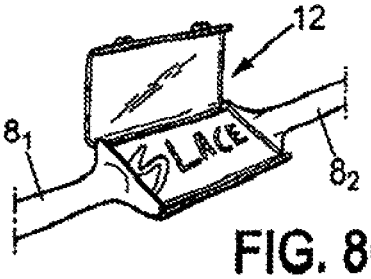
FIG. 8C
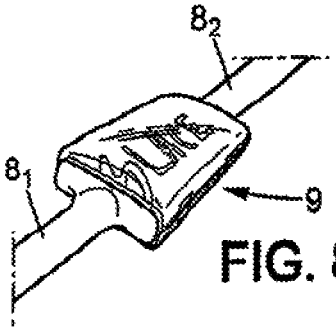
FIG. 8D

SILICONE LACE WITH A STRONG VISUAL IDENTITY AND IMPROVED TEAR STRENGTH, AND LACING SYSTEM FORMED BY A PLATE FOR LOCKING THE LACE IN PLACE ON THE SHOE

FIELD OF THE INVENTION

The present invention relates generally to shoelaces. In particular, elastic laces, for example made from elastomer, e.g. silicone, which once in place on a shoe, allow the latter, in the interests of comfort, to adapt to the variations in the volume of the user's foot, without detracting from the necessary support for the foot, and also allow the user to don and doff the shoe repeatedly without undoing the laces.

It relates to sports shoes, orthopaedic shoes, town shoes, etc.

STATE OF THE ART

Laces are flexible cords that are inserted into keepers, eyelets, loops, hooks, etc. and are tied for fastening the shoe to the foot.

Conventionally, the laces are produced from natural (cotton, jute or hemp) or synthetic (polyesters, polyamides, polyolefins: polyethylene, etc.) fabrics, from leather or from elastic material.

The ends of the laces comprise a stiff portion making it possible to thread them through the keepers more easily, and in the case of fabric laces, to prevent fraying of said ends.

Due to their elastic elongation properties, the elastic laces are intended to prevent excessive tightening which damages the feet and obstructs blood circulation.

Among the elastic laces already on the market, twisted laces or laces having self-locking bulges may be mentioned.

Laces made from silicone elastomer are also known, available for sale under the trade mark Freelace® since 2013.

Silicone elastomers are polymers based on silicon, carbon, oxygen and hydrogen. They have elastic properties that are obtained after cross-linking, allowing them to withstand significant deformation before rupture. They also have an elastic collision capability, such as elastic resilience and stretching, which allows them to return to their initial shape after the stress has ceased.

These silicone elastomer laces benefit from another property of silicones, which is anti-adhesivity, so that they are self-locking.

They are manufactured conventionally by injection moulding or by extrusion.

However, these silicone elastomer laces available on the market can be improved, in particular as regards their publicity potential and their aesthetic attractiveness. Similarly, the known silicone elastomer laces could be improved with respect to their tear strength.

Furthermore, as it relates to lacing, the laces are tied over the instep, with bows or double bows. Rarely with the double bow, but frequently with the single bow, the bows come untied, which requires the wearer of shoes fastened with these untied laces to re-tie the bow, otherwise risking spoiling the shoelaces or stepping on them and falling.

These ties are not always aesthetically pleasing and can affect the attractiveness of the design of the shoe.

Objectives of the Invention

The present invention aims to provide laces made from silicone elastomer that are improved in terms of branding and/or in terms of decoration and/or in terms of improvement in tear strength and/or in terms of the addition of new functionalities other than the mechanical properties and the external appearance.

The present invention also aims to provide a pragmatic, aesthetically pleasing and security-conscious solution to replace the conventional shoe ties, also in respect of the fastening of the laces (lacing) that serves to gather and lock the ends of the lace with respect to the shoe equipped with said laces. It would be desirable for this solution to remove the risk of untying of the laces and give a refined appearance to the shoe.

This solution is a new lacing system.

BRIEF DESCRIPTION OF THE INVENTION

The present invention satisfies all or part of these objectives by proposing a novel lace for a shoe provided with a lace passage, the two edges of which have keepers, said lace being essentially constituted by at least one at least partially cross-linked silicone elastomer and comprising one or more silicone polymers and fillers, and, optionally, at least one of the following compounds: catalyst(s), cross-linking agent(s), pigment(s), anti-adhesivity agent(s), plasticizer(s), adhesion promotor(s), characterized in that it comprises, in its median part, an identity zone that forms a single piece with the lace, which is intended, once the lace has been put in place through the keepers of the shoe, to appear over the instep of the shoe, between the two lower keepers situated on either side and at the base of the lace passage.

This lace has a distinctive and attractive visual identity on the shoe, which emphasizes its distinctive character and therefore its commercial appeal. The lace according to the invention is thus provided with a branding at its centre. This location, the shape of which is for example rectangular, highlights the brand chosen for the lace. Its location between the two first keepers (e.g. eyelets) and its shape perfectly identify the supplier of the lace, differentiating it from the shoe and thus forming a commercial item in its own right, having advantageous technical properties.

The lace according to the invention also has at least one of the following features:

- The identity zone has a generally polygonal shape, preferably rectangular.
- The identity zone comprises, on its visible outer face, at least one word and/or figurative identity and/or publicity sign of the lace.
- This word and/or figurative identity and/or publicity sign is at least partially formed by recesses of the identity zone.
- This lace comprises a support having patterns in relief corresponding to at least a part of the word and/or figurative identity and/or publicity sign, in which said patterns in relief are at least partially inserted into the recesses of the identity zone, preferably such that the upper part of these patterns in relief projects with respect to the visible outer face of the identity zone, in order to display in relief at least part of the word and/or figurative identity and/or publicity sign.
- According to a variant, the word and/or figurative identity and/or publicity sign is at least partially formed by impressions, hollow and/or in relief, and/or by ink printing, carried out on the visible outer face of the identity zone.

According to an interesting possibility, at least part of the word and/or figurative identity and/or publicity sign is of a different colour to the identity zone, so as to be visible by contrast.

The identity zone is at least partially, preferably on its visible outer face, covered by a transparent cover, preferably constituted by a single part covering the visible outer face of the identity zone, or two parts, optionally hinged, covering respectively the visible outer face and the hidden inner face of the identity zone or of the support.

In order to add other functionalities to the laces, it is provided that the latter may comprise at least one of the elements selected from the group comprising:

one or more electronic devices preferably selected from: RFID chip, GPS chip, sensors for measuring the physical activity of the user: pedometer, accelerometer, speed indicator, physiological parameters; transmitter/receiver of signals;

light(s), LED light(s), in particular for highlighting the word and/or figurative identity and/or publicity sign, by a lighting effect itself enhanced by the transparent plastic cover covering at least partially, preferably at least the visible outer face of the identity zone;

electrical power source(s): battery cell(s), battery(ies), solar arrays;

anti-counterfeit authenticity markers.

This lace can also be characterized by tear strength determined according to standard ASTM D 624, expressed in N/mm and given hereinafter in an increasing order of preference greater than or equal to: 1; 2; 3; 4; 5; this tear strength being even more preferably comprised between 5 and 20 N/mm.

Preferably, the lace (1) according to the invention is characterized in that it is intended to be locked with respect to the shoe by a plate called "BlocKnot" equipped with several passages that hold the lace by interlocking of the free end portions of the lengths thereof in the passages and thus by gripping, preferably by passing the free end portions of the lengths thereof through the passages alternatively on the face and on the reverse of the plate.

Advantageously, the plate for locking the lace with respect to the shoe has a generally to rectangular or oblong shape, and better still with a median region that is narrower than the end regions. According to other variants, this plate can be circular, triangular, trapezoid, etc.

According to a remarkable feature of the invention, the curve of the plate for locking the lace with respect to the shoe follows the curvature of the foot. To this end, the material constituting the plate can be a flexible material or a preformed rigid material such as wood or PVC. The curved preforming in side view of the plate can be obtained by machining, bending, moulding. Thus, the curvature of the plate best fits the physiological curvature of the foot and more precisely of the instep.

In another of its aspects, the invention relates to a set of laces comprising a plate called "BlocKnot" (30) for locking the lace (1) with respect to the shoe (2), said plate being defined above, and a lace in particular a lace (1) according to the invention.

The number of passages in the plate for locking the lace, more precisely the end of the lengths of the lace with respect to the shoe, is for example a minimum of 6 to a maximum of 10.

Advantageously, said locking plate can have identity and/or decorative signs, preferably on its face, i.e. its visible front face. This can be for example logos or other graphics on its flat surface. Such a decoration can be carried out in particular by printing, welding, sublimation.

The locking plate can be produced from various materials, according to the chosen aesthetic outcome and/or according to the desired ergonomics. It can be for example a semi-rigid material, thus ensuring the adaptation of the plate to the shape of the foot.

This novel solution for tying shoelaces for lace-up shoes (called "BlocKnot") is an advantageous substitute for traditional shoelace ties. It is a secure lacing system.

This plate, which constitutes the essential means of this lacing solution, is also intended to improve the look of the shoe through its shape and refined appearance. It can be of different colours, different materials, so as to go together with the laces and the shoe. Its visible front face (facing side) can act as a support for logos and visuals in order to highlight the shoe/lace/locking plate set.

In order to contribute to safety, the lacing system according to the invention, namely the locking plate, advantageously incorporates visual signalling means, for example lights such as LEDs.

Advantageously, the holes for passing the free ends of the lengths of the lace into the plate can have different shapes corresponding to the shape of the cross-section of the lace, e.g. circular, oblong, rectangular, trapezoid, triangular, etc.

DETAILED DESCRIPTION OF THE INVENTION

The Elastomer Silicone Material

The lace according to the invention is preferably produced in a single piece by a conventional forming technique that can be injection moulding or the extrusion of a silicone elastomer, being presented in liquid form then cross-linking in the mould or at the output of the extrusion die.

The silicon elastomer or silicone rubber can be of the type elastomer gum (synthetic rubber (SR)), high temperature vulcanizing (HTV) under the action of a peroxide, or at room temperature (RTV) either under the action of an alkyl silicate in the presence of an organo-stannous catalyst, or in the presence of a cross-linking catalyst in particular based on a platinum salt. These silicone elastomers are also known as HCR: "High Consistency Silicone Rubber". Peroxide, platinum or fluorinated HCRs exist. It can be a variant of the liquid (LSR) or extra liquid (XLR) type generally hot-vulcanizing by means of a cross-linking catalyst, in particular based on a platinum salt, and the viscosity of which is for example comprised between 30 and 200 Pa·s, and more precisely of the order of 100 Pa·s. It may also be cellular silicone.

In order to improve the tear strength of the cross-linked silicone elastomer forming the lace, it is advisable according to the invention to incorporate in the formulation of the elastomer for example, pyrogenic silicas the BET specific surface areas of which are >100 $m^2/g$, precipitation silicas, inert fillers, for example based on quartz or diatomaceous earths or carbon black.

After cross-linking, the Shore hardness A is for example comprised between 30 and 100, and preferably between 40 and 80.

The Structure of the Lace

On either side of its median identity zone, the lace is a cord or strand made from silicone elastomer with a polygonal cross-section, for example rectangular, circular, or any other shape suitable for threading through the keepers of the shoe.

Similarly, its dimensions in cross-section must be such that they allow passage through the keepers of the shoe, for example a few millimetres.

The lace can be of different lengths corresponding to the current standards, for example: from 800 to 1800 mm.

According to a preferred embodiment, the lace is constituted by two lengths each joined together in the median portion of said lace to the identity zone, which preferably forms, with the two lengths, one and the same moulded piece, in particular injection moulded.

For example, the identity zone forms an integral part of the lace. The lace constituted by the identity zone and the two lengths is preferably produced from one and the same material, namely silicone elastomer, and advantageously in one and the same operation.

According to another advantageous embodiment, the two lengths of the lace have substantially the same length and the identity zone is then a means of centring the lace between the two lower keepers situated on either side and at the base of the lace passage on the shoe.

Furthermore, according to the invention, the lengths of lace on either side of the identity zone can have, independently of one another, a cross-section that is constant or variable in shape and dimensions.

A model intended simply for running can have for example two lengths having a rectangular cross-section over their entire length and each terminated by a chamfer of approximately 30° allowing the lace to be easily threaded through the eyelets of the shoes.

The lacing can be finished, or not, by a traditional bow or by a small knot at the end of each last eyelet and by cutting off the surplus lace.

Instead of the traditional knot, it is preferable according to the invention to finish the lacing by locking the free ends of the lengths of lace, vis-a-vis the shoe, using the plate according to the invention called "BlocKnot", which is provided with several passages that hold the lace by the threading of the lace through the passages and thus by gripping.

The silicone lace has a coefficient of friction such that it is possible to keep the position of the lace vis-a-vis the locking plate, after inserting said lace into the passages of said plate as if sewing a stitch.

A model intended for intensive weight-bearing sports can have for example two lengths each having different cross-sections over their length distributed over several distinct zones.

This model can be broken down into three sizes, thus responding to the needs of users with different foot sizes: S-M-L. Size L can correspond for example to a length of 920 mm.

Embodiments of the lace according to the invention are described hereinafter with reference to the attached drawings in which:

FIG. 6 is a rear view of the identity zone of the lace showing the hidden rear face of the support for the relief patterns in FIG. 3;

FIGS. 7A 7B 7C 7D show a first variant embodiment of the lace according to the invention in which the transparent cover is in two parts;

FIGS. 8A 8B 8C 8D show a second variant embodiment of the lace according to the invention in which the transparent cover is in two parts with an identity zone having a central region that is narrowed with respect to its ends.

Figure 1:
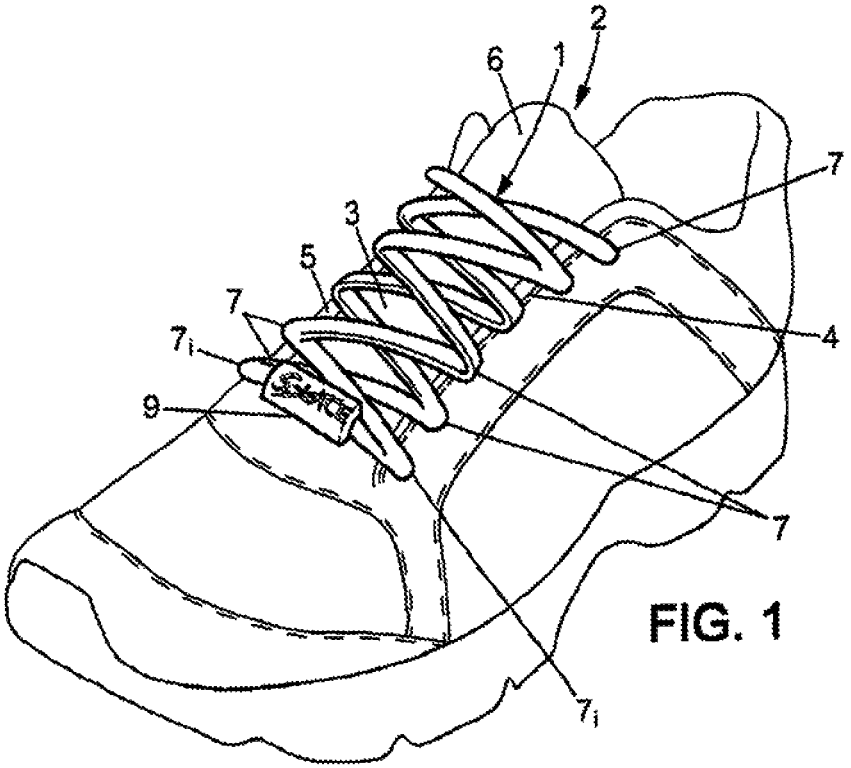
FIG. 1 shows a perspective view of the lace in place on a shoe.

As shown in FIG. 1, the lace 1 according to the invention makes it possible to secure the fastening of the user's foot in a shoe 2, which in this case is for example a sports shoe. Conventionally, this lace 1 is arranged over a passage 3 provided over the instep of the shoe 2 and delimited by two lateral edges 4, 5 and by a tongue 6 of the shoe 2. These two lateral edges 4, 5 have keepers 7*i* into which the lace 7 is threaded in zigzag fashion, from the base of the passage 3 and more particularly the two lower keepers 7*i*.

Figure 2A:
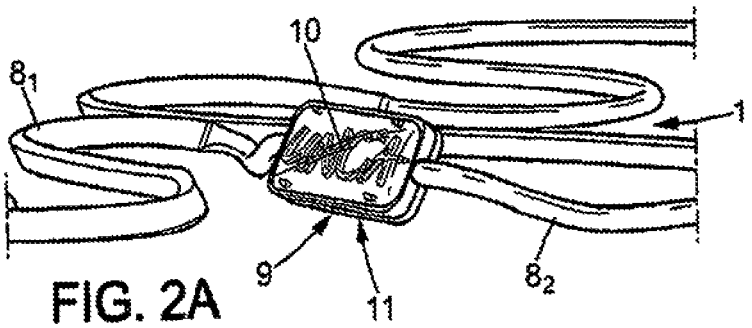
FIGS. 2A and 2B are perspective views of two decorative variants of the identity zone of the lace according to the invention.
Figure 2B:
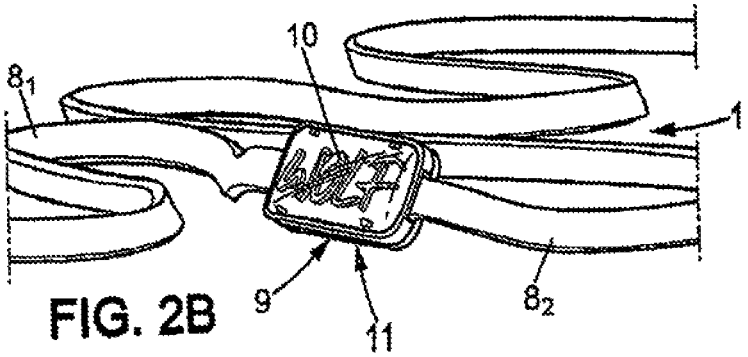
Figure 3:
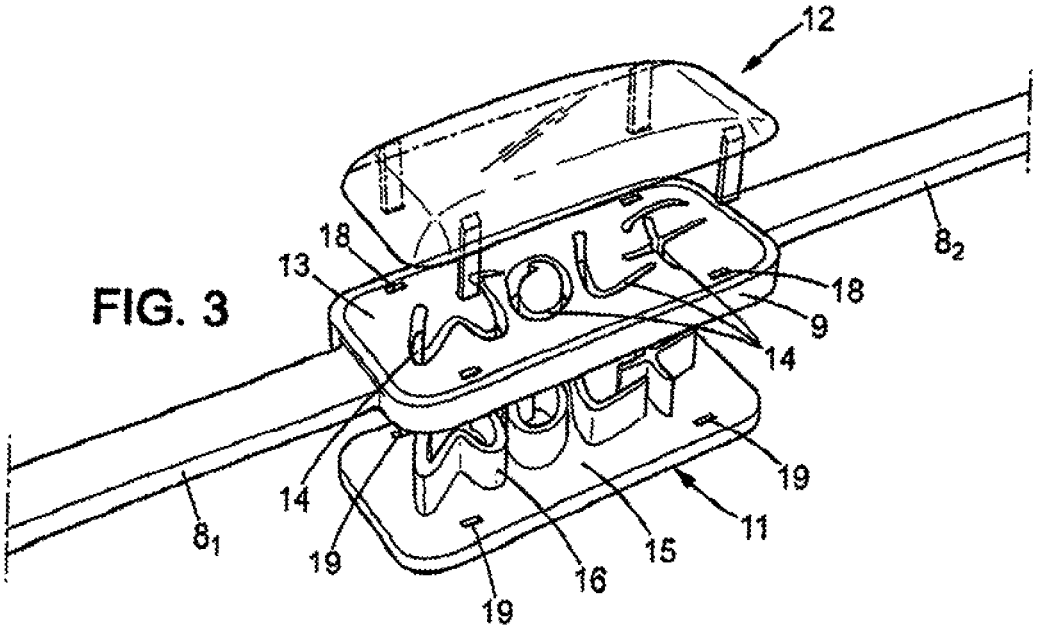
FIG. 3 is an exploded perspective view of the identity zone of the lace according to a preferred embodiment according to the invention.
Figure 4:
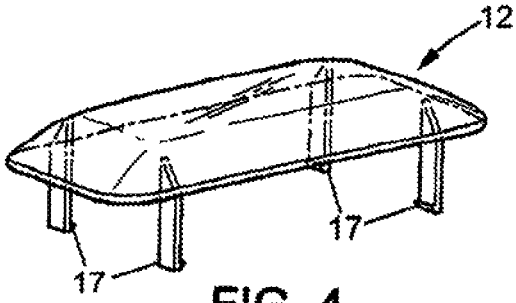
FIG. 4 is a perspective view of the transparent cover shown in FIG. 3.
Figure 5:
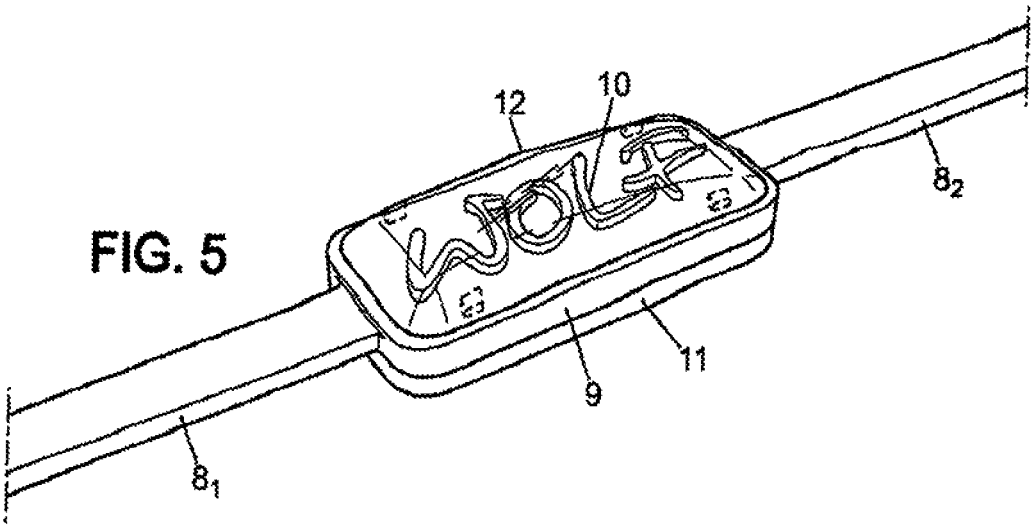
FIG. 5 is a view of the identity zone of the lace in FIG. 3 in assembled mode.

This lace 1 is a strand made from cross-linked silicone elastomer constituted by two lengths $\mathbf{8}_1$ et $\mathbf{8}_2$ each joined in the median portion of the lace 1 to an identity zone 9, which is constituted in this case, as an example, by a rectangular-shaped plate, and which has a word identity and/or publicity sign 10, formed in FIGS. 2B, 3 and 5 by the name "WOLF" and in FIG. 2A by the name "UNCIA".

The two lengths $\mathbf{8}_1$ & $\mathbf{8}_2$ of the lace 1 in this embodiment have a rectangular cross-section (e.g. length of 4 mm and width of 2 mm) forming with the identity plate/zone 9, one and the same injection-moulded piece.

As shown in FIGS. 3 to 6, the lace 1, and more particularly its identity plate/zone 9, is sandwiched between on the one hand, a rectangular support 11 situated below the identity plate/zone 9, and on the other hand, a transparent cover 12 (FIG. 4) shown arranged opposite the visible outer face 13 of the identity plate/zone 9.

Furthermore, the identity plate/zone 9 comprises recesses 14 that correspond to the word identity and/or publicity sign 10, in this case the name "WOLF". The rectangular support 11 that has substantially the same dimensions as the new identity plate/zone and which is produced for example from a moulded plastic material such as polyvinyl chloride (PVC), polyethylene terephthalate (PET) or polyethylene (PE), has on its upper face 15 (with reference to the arrangement of FIGS. 1, 2A, 2B and 3) a pattern 16 in relief corresponding to the word identity and/or publicity sign 10, in this case the name "WOLF", which is pushed into the recesses 14 of the identity plate/zone 9 and has a height such that in relation to the thickness of the identity plate/zone 9 the upper portion of said pattern 16 projects with respect to the visible outer face 13 of the identity plate/zone 9.

These structural features create an aesthetically pleasing and attractive visual effect that particularly highlights the word identity and/or publicity sign 10, in this case the name "WOLF".

This effect is further emphasized by the transparent cover 12 which is anchored in the identity plate/zone 9 by means of four pins 17 that are inserted and held in holes 18, 19 aligned and arranged, respectively, in the silicone elastomer identity plate/zone 9 and in the rectangular support 11, as shown in FIG. 3.

This relief pattern 16 and this transparent cover 12 optimize the commercial visibility of the lace 1.

FIG. 1 shows that the lace 1 equipped with its plate/zone 9 bearing the word and/or figurative and/or publicity sign 10, stands out from the shoe 1 and appears to the consumer as an accessory in its own right, independent of the shoe 2. The arrangement of the identity plate/zone 9 at the base of the passage 3 of the shoe 2, between the 2 lower keepers 7*i*, is a place of choice for highlighting the trade mark of the lace 1.

As shown in FIG. 6, the lower face 20 of the rectangular support 11, resting on the tongue 6 of the shoe 2, between the two lower keepers 7*i* of the passage 3, can be used as support for identity information 21 or anti-counterfeiting marking/tracing.

Moreover, according to advantageous variants of the invention, the rectangular support 11 and/or the identity plate/zone 9 made from moulded silicone elastomer may contain or support miniaturized electronic devices (RFID, GPS, video capture, sensors of physiological parameters, meteorological sensors, transmitter/receiver, etc.), electrical power sources, lights, etc. Every one of them means making it possible to equip the lace (1) with multiple functionalities at the service of the user.

FIGS. 7A to 7D show a $1^{st}$ variant of the cover 12 constituted by 2 hinged parts $\mathbf{12}_1$ et $\mathbf{12}_2$ and encapsulating the silicone elastomer identity plate/zone 9, extended by the 2 lengths $\mathbf{8}_1$, $\mathbf{8}_2$ produced from the same material and in a single piece. The word identity and/or publicity sign 10 is here constituted by the name "S-LACE".

FIGS. 8A to 8D show a $2^{nd}$ variant of the cover 12, again constituted by 2 hinged parts $\mathbf{12}_1$ et $\mathbf{12}_2$ and encapsulating the silicone elastomer identity plate/zone 9, extended by the two lengths $\mathbf{8}_1$, $\mathbf{8}_2$ produced from the same material and in a single piece. The word identity and/or publicity sign 10 is here again constituted by the name "S-LACE". But, in a manner different from the first variant of FIGS. 7A-7D, the identity plate/zone 9 comprises 2 ends each forming an intermediate region $\mathbf{80}_1$, $\mathbf{80}_2$ connecting with the length $\mathbf{8}_1$, $\mathbf{8}_2$ respectively. These end regions $\mathbf{80}_1$, $\mathbf{80}_2$ are thicker than the rest of the identity plate/zone 9. The hinged transparent cover 12 covers this thinned zone situated between the two end regions $\mathbf{80}_1$, $\mathbf{80}_2$.

In the two variants in FIGS. 7A-7D and 8A to 8D, the two hinged parts $\mathbf{12}_1$ and $\mathbf{12}_2$ of the transparent cover 12 are assembled together for example by means of clips.

Manufacturing the Lace

The lace 1 is advantageously injection-moulded from a non cross-linked silicone raw material, for example of the type based on LSR or HCR and marketed under the name of ELASTOSIL® R, FLR or LR, or also CENUSIL® R 340 by the company WACKER.

The injection moulding device can be for example an injection moulding machine YIZUMI YL-V360L, YL-AB500L or YL-AB550L for silicone rubber.

A further subject of the invention is formed by a method for the manufacture of laces as defined in the present disclosure, said method consisting essentially of:

- utilizing a non cross-linked silicone raw material, comprising one or more silicone polymers and fillers, and optionally at least one of the following compounds: catalyst(s), cross-linking agent(s), pigment(s), anti-adhesion agent(s), plasticizer(s), adhesion promoter(s);
- carrying out the forming of the lace by extrusion or injection moulding of this silicone raw material, such that this raw material is cross-linked and converted to hardened silicone elastomer, after shaping within the extruder or mould;
- optionally cutting the lace to the correct length;
- collecting the laces thus obtained;
- cooling said laces;
- packaging said laces with a view to their sale.

The Plate for Locking the Free Ends of the Lengths of the Lace with Respect to the Shoe.

The Material of the "BlocKnol" Plate

The "BlocKnot" plate according to the invention is preferably produced in a single piece by different manufacturing techniques according to the selected material: for example moulding of a plastic material then perforation in order to produce the passages for the lace in the plate.

It is recommended according to the invention to use materials known as "semi-rigid" in order to obtain flexibility for harmonisation between the curvature of the foot and the plate and a minimum of rigidity in order to lock the lace by passing it through the succession of holes. By way of example of a suitable semi-rigid material, there may be mentioned: sheet polypropylene of approximately 1 mm in thickness.

According to a variant and in particular for aesthetic reasons, wood can be used as the material constituting the plate. A curve is machined in order to correspond to the shape of the foot, more particularly the instep.

According to another variant, a flexible material is used such as a silicone material, for example of the same type as that constituting the lace according to the invention. The flexibility of a silicone material allows very good adaptation to the shape of the foot. Moreover, the silicone of the locking plate, like the silicone of the lace, would contribute to the locking of these 2 elements with respect to one another (no slipping: high coefficient of friction).

For use on elastomer type laces calling for donning and doffing without undoing the knots, the use of a stretch-resistant material is recommended.

The Structure of the "BlocKnot" Plate

Said plate generally has a rectangular shape. But it can have variants such as triangle, circle etc. It can also have shapes known as personalized, that can adopt the contour of a trade mark logo, for example.

Its dimensions can vary according to the nature of the material or the size of the shoe. The invention is often produced in dimensions known as standard, of 20 mm wide by 50 mm long. The ends are 50 mm wide by 100 mm long.

Its thickness also varies according to the thickness of the selected material Taking polypropylene as an example, a 20 mm by 50 mm plate will have a thickness varying between 0.5 mm and 1.2 mm thick, 0.8 being a good average.

The holes for passage of the laces can have different shapes. Their size is generally smaller than the lace used. Passing the lace into the succession of 3 holes (as a minimum), which furthermore are smaller, locks the lace by braking effect and by gripping.

Figure 9:
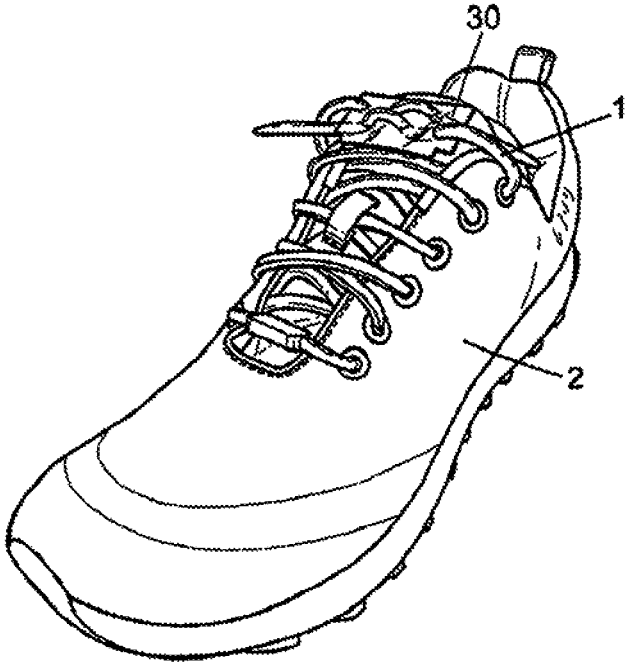
Figure 10:
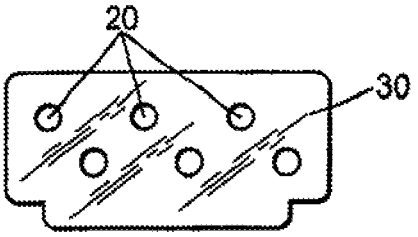

Embodiments of the "BlocKnot" plate according to the invention are described hereinafter with reference to the attached drawings in which:

FIG. 9 shows a perspective view of the "BlocKnot" plate in place on a shoe;

FIG. 10 shows a face view of the plate shown on FIG. 9.

Figure 11:
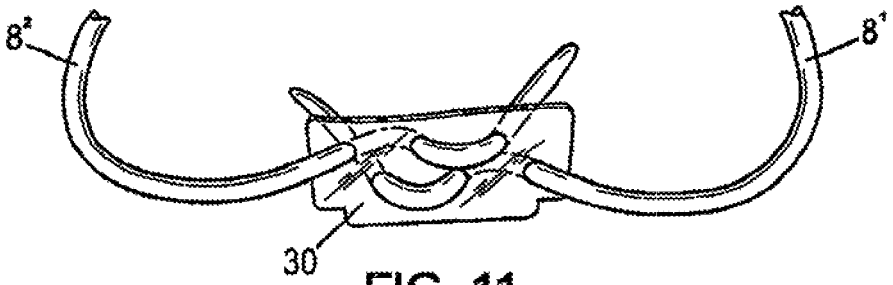

FIG. 11 shows a view of the plate free of the shoe, with laces of the elastomer type positioned above without the shoe.

Figure 12:
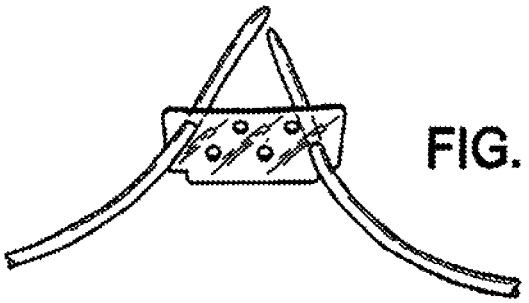
Figure 13:
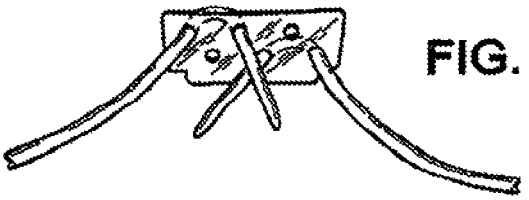
Figure 14:
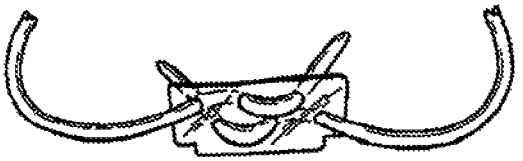

FIGS. 12 to 14 show the different steps of installing the lace.

Figure 15:
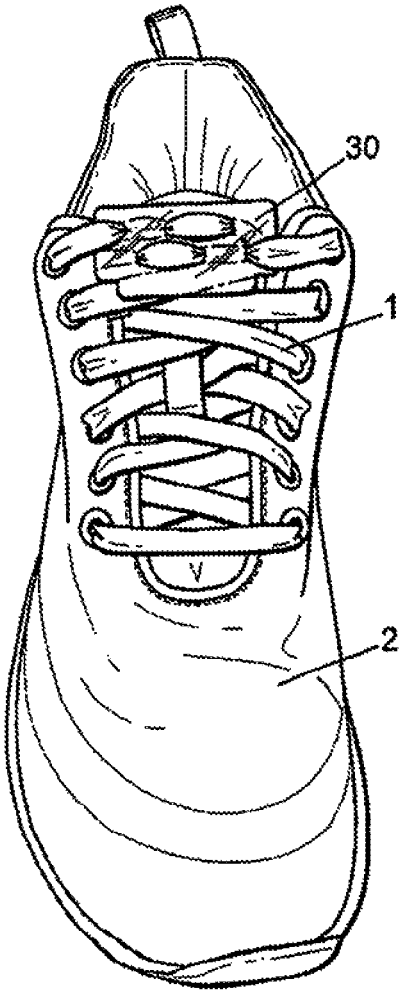

FIG. 15 shows use with a flat textile lace.

Figure 16:
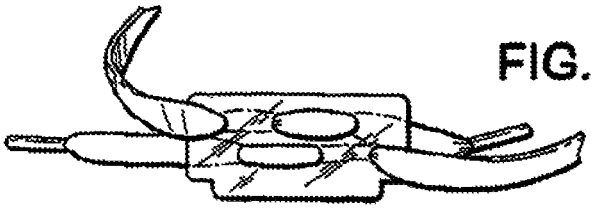
Figure 17:
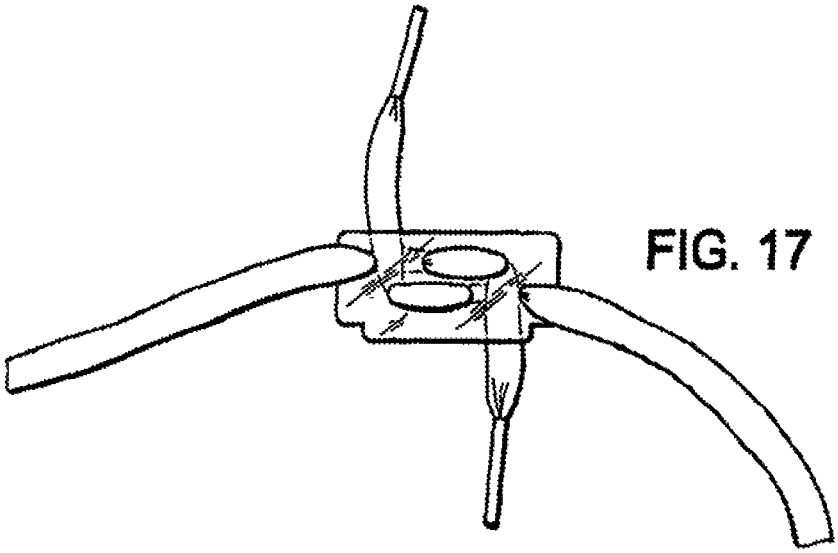

FIGS. 16 and 17 show possible finishes.

Figure 18:
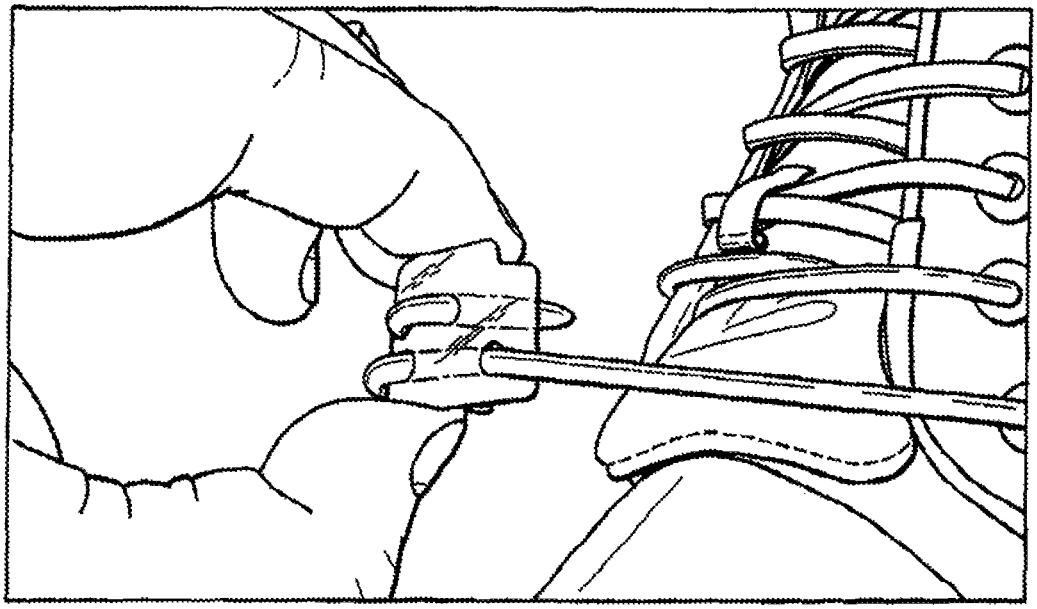

FIG. 18 demonstrates the strength of the "BlocKnot" plate and the efficiency of the gripping system for shoelaces via a succession of holes.

Figure 19:
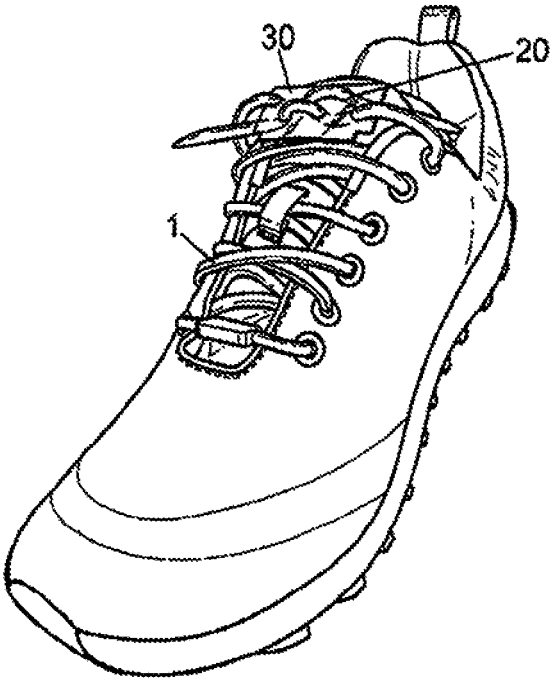
Figure 20:
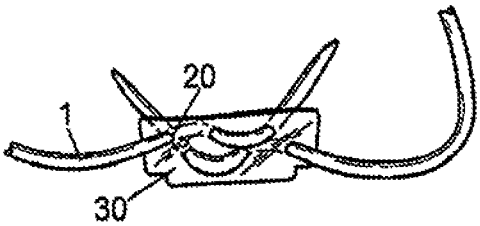
Figure 21:
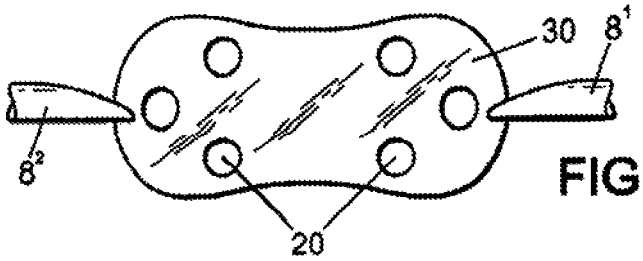
Figure 22:
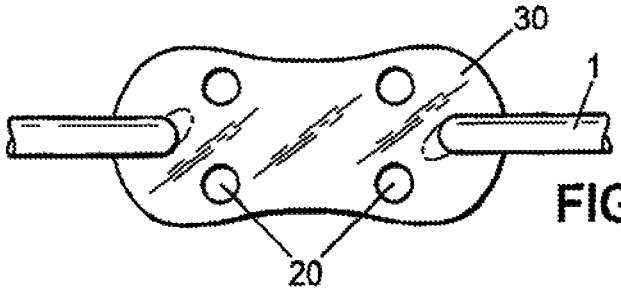
Figure 23:
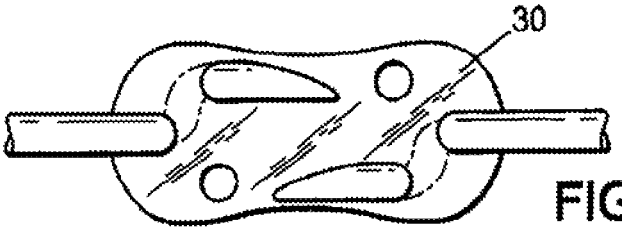
Figure 24:
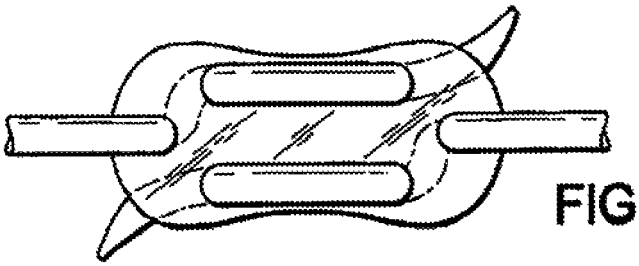
Figure 25:
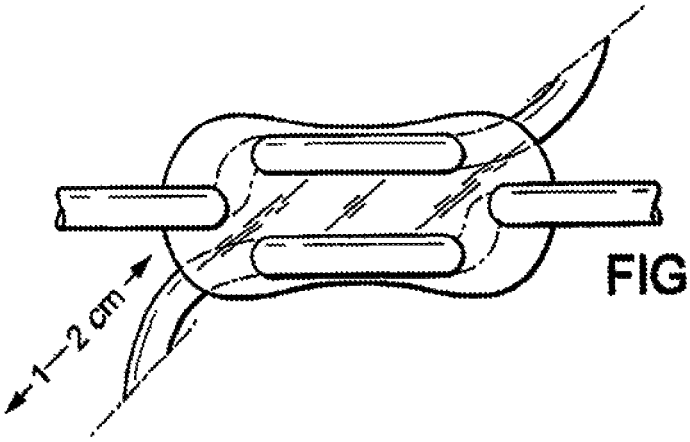

FIG. 19 shows a perspective view of the "BlocKnot" plate in place on a shoe, FIG. 20 shows the locking plate and the ends of the laces locked in the passages of the plate.

FIGS. 21 to 25 show a method of use of the locking plate.

Figure 26:
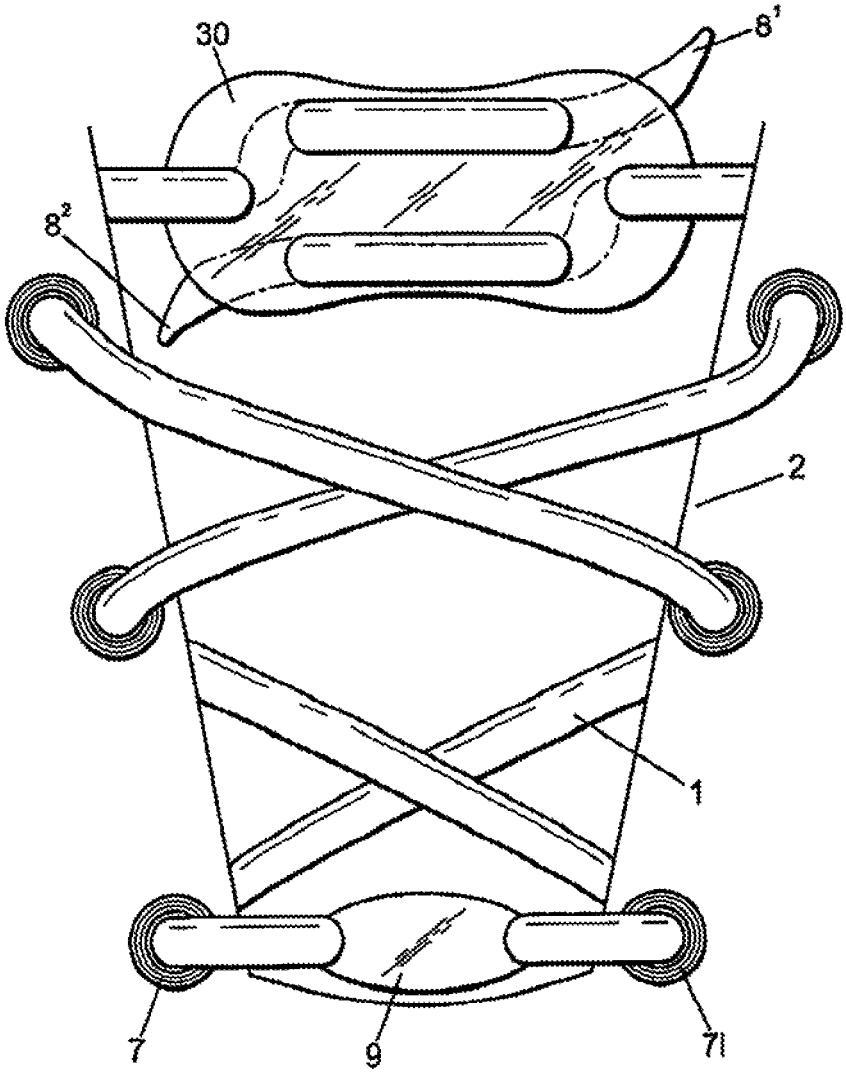

FIG. 26 shows a face view of a part of the shoe with a lacing carried out using the silicone lace according to the invention and the locking plate according to the invention.

Figure 27A:
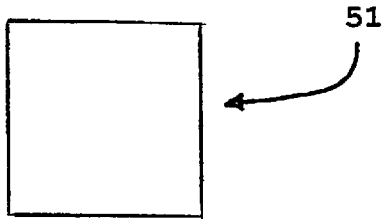

FIGS. 27A-D show individual elements which may preferably be located on the identity zone of the lace:

FIG. 27A is a block illustration of an electronic device 51, such as an RFID chip, a GPS chip, a pedometer, an accelerometer, or a speed indicator.

Figure 27B:
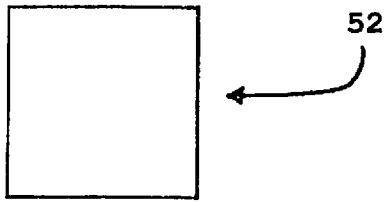

FIG. 27B is a block illustration of a light 52, such as a LED light, for highlighting a visible outer face of the identity zone.

Figure 27C:
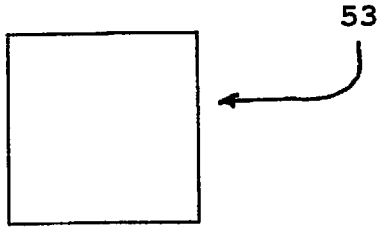

FIG. 27C is a block illustration of an electrical power source 53, such as a battery cell or solar array.

Figure 27D:
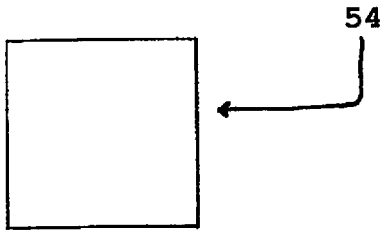

FIG. 27D is a block illustration of an anti-counterfeit authenticity marker 54.

The invention claimed is:

1. A system comprising a lace (1) and plate (30) for a shoe (2), said shoe being provided with a lace passage (3) having two edges (4, 5) and a base, said edges having keepers (7, 7*i*) situated on either side and at the base of lace passage (3), said lace (1) comprising at least one at least partially cross-linked silicone elastomer, comprising one or more silicone polymers and fillers, and at least one member of the group consisting of catalysts, cross-linking agents, pigments, anti-adhesion agents and plasticizers, an identity zone (9) that forms a single piece with the lace (1), and which is adapted, once the lace (1) has been put in place through the keepers (7, 7*i*) of the shoe (2), to appear over an instep of the shoe (2), between said keepers at the base of the lace passage (7*i*) and two lengths (81, 82) each joined together in a median portion of said lace (1) to the identity zone (9), which forms, with the two lengths (81, 82), an integral molded piece, wherein the two lengths (81, 82) have substantially the same length, said lace having a tear strength determined according to standard ASTM D 624 between 5 and 20 N/mm, and said plate (30) having several passages (20) adapted to hold said lace (1) to said shoe (2) by interlocking of free end portions of said lengths (81, 82) thereof in said passages (20).

2. The system according to claim 1, wherein the identity zone (9) has a polygonal shape, and comprises, on a visible outer face (13), at least one word, figurative identity or publicity sign (10).

3. The system according to claim 2, wherein the word, figurative identity or publicity sign (10) is at least partially formed by recesses (14) of the identity zone (9).

4. The system according to claim 3, wherein the lace further comprises a support (11) having patterns (16) in relief corresponding to at least a part of the word, identity or publicity sign (10), and wherein said patterns (16) in relief are at least partially pushed into the recesses (14) of the identity zone (9), so that the upper part of these patterns (16) in relief projects with respect to the visible outer face (13) of the identity zone (9), in order to display in relief at least part of the word, figurative identity or publicity sign (10).

5. The system according to claim 2, wherein the word, figurative identity or publicity sign (10) is at least partially formed by impressions, hollow, and/or in relief (16), or by ink printing, carried out on the visible outer face of the identity zone (9).

6. The system according to claim 2, wherein at least part of the word, figurative identity or publicity sign (10) is of a different colour than identity zone (9), so as to be visible by contrast.

7. The system according to claim 1, wherein the identity zone (9) is at least partially covered by a transparent cover (12).

8. The system according to claim 1, wherein plate (30) has a rectangular or oblong shape.

9. The system according to claim 1, wherein plate (30) has a curve conforming to the curvature of the foot.

* * * * *